US010748455B2

(12) United States Patent
Lemacks et al.

(10) Patent No.: US 10,748,455 B2
(45) Date of Patent: Aug. 18, 2020

(54) SINGLE SIDE FASTENING SYSTEM FOR IDENTIFICATION PLACARD FOR UTILITY VAULT LIDS

(71) Applicant: CHANNELL COMMERCIAL CORPORATION, Temecula, CA (US)

(72) Inventors: Michael A. Lemacks, Temecula, CA (US); Timothy S. Safranek, Heath, TX (US); Christopher M. Watson, Nashville, NC (US); Edward J. Burke, Temecula, CA (US)

(73) Assignee: Channell Commercial Corporation, Temecula, CA (US)

( * ) Notice: Subject to any disclaimer, the term of this patent is extended or adjusted under 35 U.S.C. 154(b) by 0 days.

(21) Appl. No.: 16/116,664

(22) Filed: Aug. 29, 2018

(65) Prior Publication Data

US 2020/0074889 A1 Mar. 5, 2020

(51) Int. Cl.

| | |
|---|---|
| ***B65D 88/76*** | (2006.01) |
| ***G09F 3/02*** | (2006.01) |
| ***G09F 3/20*** | (2006.01) |
| ***B65D 90/10*** | (2006.01) |
| *E02D 29/14* | (2006.01) |

(52) U.S. Cl.

CPC ..... *G09F 3/20* (2013.01); *B65D 88/76* (2013.01); *B65D 90/105* (2013.01); *G09F 3/02* (2013.01); *E02D 29/1472* (2013.01)

(58) Field of Classification Search

CPC ..... G09F 3/20; B65D 88/76
USPC ..... 40/606.1, 663, 668, 622, 607.13, 607.15
See application file for complete search history.

(56) References Cited

U.S. PATENT DOCUMENTS

| | | | | |
|---|---|---|---|---|
| 1,400,155 A | | 12/1921 | Greenburg | |
| 4,915,343 A | * | 4/1990 | Terlecke | A47H 1/14 248/222.41 |
| 4,978,265 A | * | 12/1990 | De Wan | F16B 13/005 411/182 |
| 5,039,262 A | * | 8/1991 | Giannuzzi | E04D 3/3603 411/30 |
| 5,090,644 A | * | 2/1992 | Lenker | F16L 5/00 174/153 G |

(Continued)

FOREIGN PATENT DOCUMENTS

| | | |
|---|---|---|
| EP | 0335803 B1 | 9/1994 |
| EP | 1881472 B1 | 1/2009 |

OTHER PUBLICATIONS

International Search Report and the Written Opinion of the International Searching Authority issued in corresponding International Appln. No. PCT/US19/48288, dated Nov. 15, 2019, 10 pages.

*Primary Examiner* — Joanne Silbermann
(74) *Attorney, Agent, or Firm* — Lewis Roca Rothgerber Christie LLP

(57) ABSTRACT

A fastener for attaching an identification placard having a post to a lid for a utility vault from a single side of the lid, the fastener includes a body portion for positioning within a hole in the lid, the fastener having tabs for retaining the fastener to the lid and lobes for preventing over insertion of the fastener into the hole in the lid and a bore extending through or partially through the body portion for receipt of and friction retention and/or mechanical interlocking of the post of the identification placard.

5 Claims, 7 Drawing Sheets

(56) References Cited

U.S. PATENT DOCUMENTS

| | | | | |
|---|---|---|---|---|
| 2006/0120822 | A1* | 6/2006 | Kaye | F16B 13/001<br>411/30 |
| 2008/0263920 | A1 | 10/2008 | Trigg et al. | |
| 2009/0285649 | A1* | 11/2009 | Kohan | F16B 13/001<br>411/38 |
| 2009/0314918 | A1* | 12/2009 | Melanson | A47G 1/164<br>248/475.1 |
| 2012/0012488 | A1 | 1/2012 | Schweinberg et al. | |

* cited by examiner

SINGLE SIDE FASTENING SYSTEM FOR IDENTIFICATION PLACARD FOR UTILITY VAULT LIDS

FIELD OF THE INVENTION

The Invention relates to a fastener system for an identification placard for a lid or cover used on an underground, grade-level or above ground vault used in various industries.

BACKGROUND

Underground or buried vaults, pits chambers or boxes used in the utilities, security, and rail line sectors or other industries can contain co-axial or optical fiber, copper cable as well as gas, water and power lines and other conduits, industrial valves, WI-FI antennas, etc. Vaults and pits for underground utilities often need to be opened for making repairs or for enhancing services. Typically, utility vaults and pits include a concrete, polymer concrete, composite or plastic lid which is opened by a tool or pick with a hook at one end. The lid includes an identification placard or "puck" on its upper surface to identify the owner of the vault or other information such as the type of industry or equipment contained within the vault.

In the course of using the underground box, the cover or lid may be installed at approximately grade level. These covers or lids of various materials such as plastic, concrete, polymer concrete and fiber reinforced composites are secured in place by various means such as straight bolts or L-bolts etc. The bolt typically passes through the cover and into the underground box where it is screwed into a retained nut or similar device thus fastening the cover to the box.

Previously, utility vault lids have been produced with owner or industry information molded onto the lid. Molding information limits the ability to redirect product to different users or build a generic inventory to be labeled prior to delivery. Consequently, because utility vaults and their associated lids are utilized across many industries and customers, manufacturers produced the lids without customer or industry specific identification. Once the vault and corresponding lid was sold to the end customer and placed into service an identification placard was positioned on the lid. Typically the identification placard is a tag having a post which was then positioned within a hole located through the lid and a fastener was positioned on the post from the bottom surface of the lid to retain the tag on the lid.

Problems with this type of fastening method included requiring access to both sides of the lid to install the identification placard. Depending upon the size of the vault and associated lid, such an installation method was cumbersome for particularly large lids. Further, such a method required the use of tools and traditional fasteners such as a threaded nut would work their way loose and fall into the vault potentially damaging expensive equipment. Further, the identification tag could become disengaged from the lid. Adhesives have also been used to retain identification placards however adhesives commonly failed leading to being banned by many utilities and agencies.

Another problem associated with this fastening method, in addition to fastening and retention problems, is that there was no provision for orienting the tag on the lid allowing the tag to rotate during installation or through actual use making the interpretation of the information on the tag more difficult to read. This method lead to the requirement of having a completely separate orientation feature for the placard and lid spaced away from the post adding to the cost and complexity of manufacture.

Therefore a need exists for an improved fastening system for attaching an identification placard to a lid or cover for an underground, grade level or above ground vault, pit, chamber or box which addresses the drawbacks of previous fastening systems.

SUMMARY OF THE INVENTION

The present invention is a fastening system for an identification placard for a cover or lid for an underground, grade level or above ground vault, pit, chamber or box which addresses the problems of prior fastening systems and can easily and inexpensively provide for the attachment and positioning of the placard to the lid. The present invention includes a fastening system, comprising a single side push nut or speed nut retainer which is a tool-less fastener that reduces the chance of failure, and allows for single side attachment and orientation of the placard to the lid without the use of adhesives.

In one embodiment, the fastener is a one side access push nut or speed nut retainer which is positioned within a through-hole or a blind hole in the lid for the vault. The fastener would include barbs or other features that retain the fastener to the inside of the hole in the lid and includes an indexing feature within the fastener for proper orientation of the identification placard. The identification placard typically is disc shaped having a post which is inserted into the fastener without tools and is secured to the fastener through a friction fit and/or prongs embedding into the mating material or interlocking into features such as grooves, recesses, notches, and rings and/or raised features. The post on the identification placard would include a groove or channel for engaging the indexing feature in the fastener for proper orientation of the placard with respect to the lid. The fastener also includes a flange or a lip that prevents the fastener from being over inserted into the hole in the lid.

In another embodiment, the invention comprises a lobed post on the identification placard which is inserted into a correspondingly shaped mating hole in the lid such that the identification placard can only be inserted into the hole in one way. The geometry of the post can include multiple lobes to ensure proper orientation. The post is retained within the hole in the lid through a friction/interference and/or compressive fit. The hole in the lid would be keyed to correspond to the geometry of the post on the identification placard.

An advantage of the fastening system of the present invention is that it allows manufacturers, distributors or customers to stock a common vault and lids and then be able to add customer or specific industry identification placards without disassembling the lid from the vault during installation and without the need for tools or access to the back of the lid. These and other aspects of the present invention will be more clearly understood by reference to the following detailed description and drawings.

DETAILED DESCRIPTION

Figure 1:
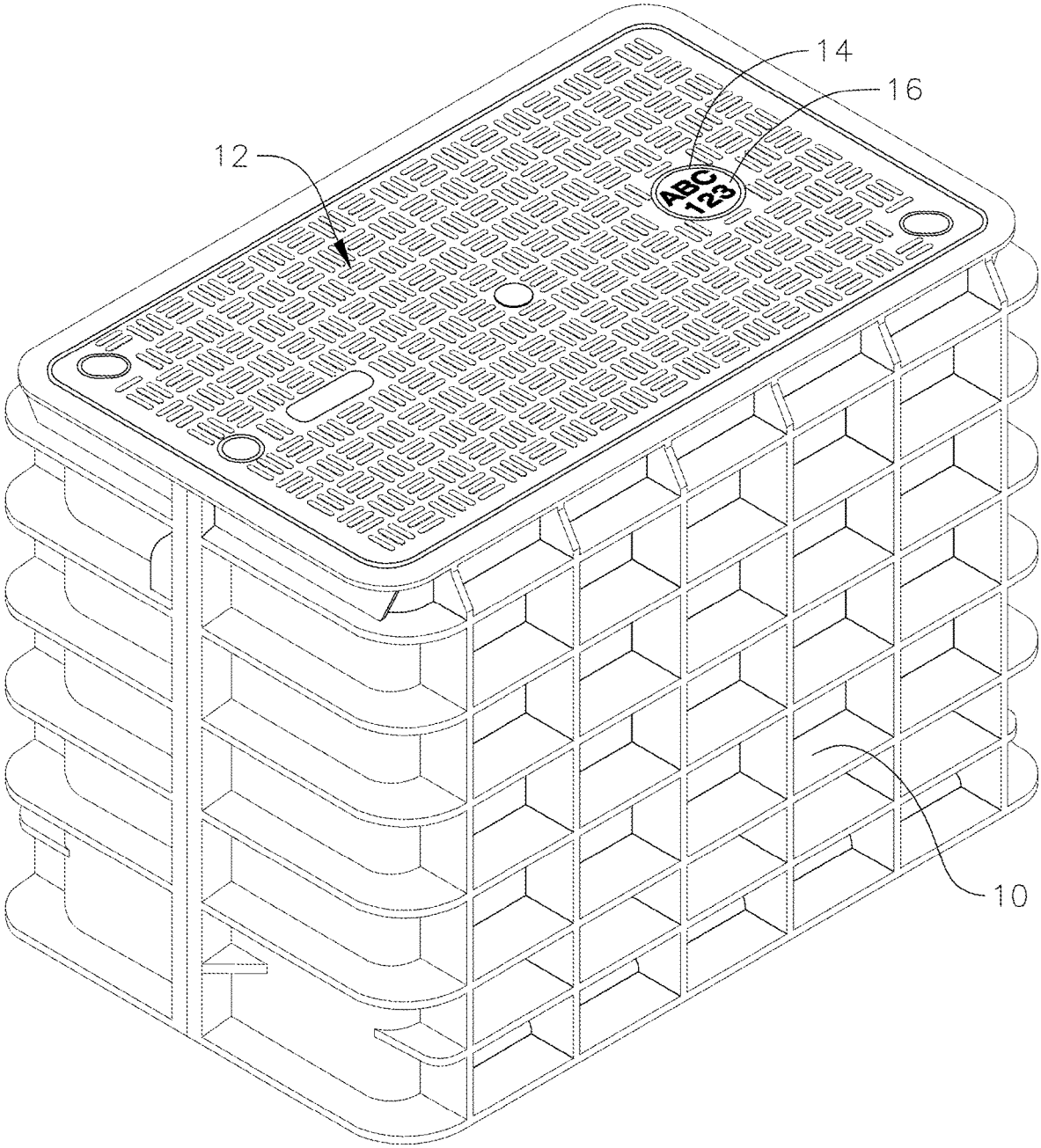
FIG. 1 is a perspective view of a utility vault and lid incorporating the fastening system of the present invention.
Figure 2:
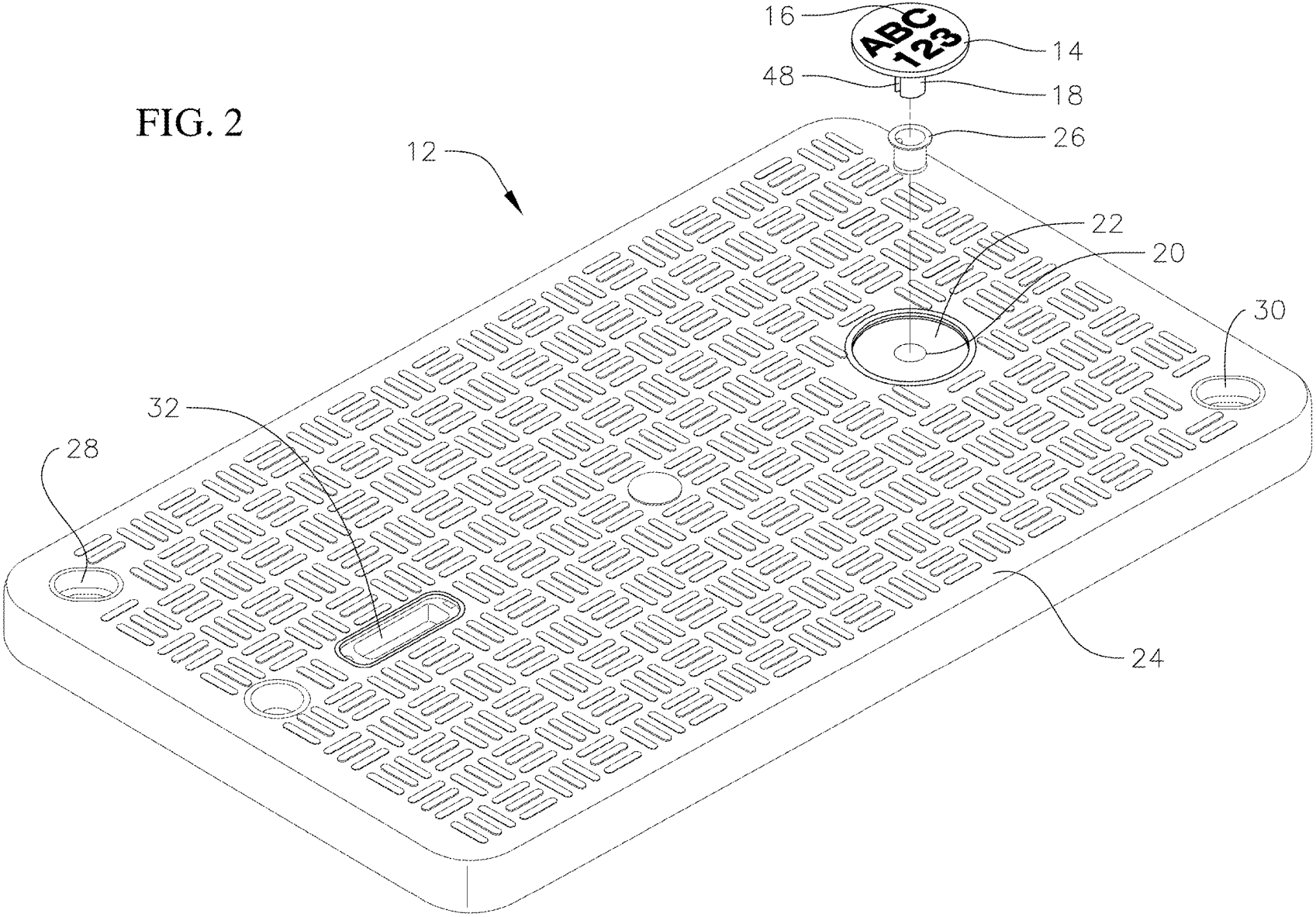
FIG. 2 is an exploded perspective view of the lid of FIG. 1.
Figure 3:
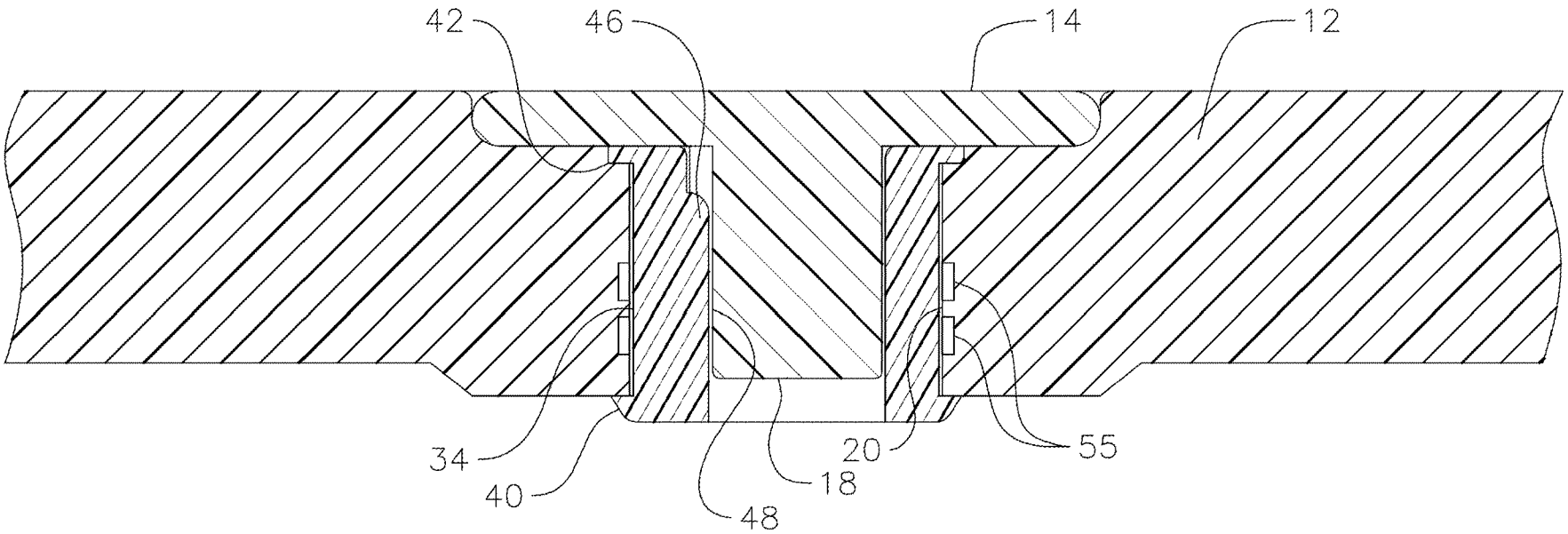
FIG. 3 is a cross-sectional view of the lid of FIG. 1.

Referring to FIG. 1, a typical utility vault 10 and corresponding lid 12 having an identification placard 14 is illustrated. The identification placard 14 has identifying indicia 16 on its surface, such as owner or other industry specific information. As also shown in FIG. 2, the identification placard 14 includes a post 18 which extends into a hole 20 which extends through the lid as also shown in FIG. 3. The lid 12 includes a recessed portion 22 for receipt of the placard 14 such that the placard is flush with the top surface 24 of the lid. The present invention incorporates a fastener 26 positioned within hole 20 which receives the post 18 to secure the placard 14 to the lid 12.

The lid 12 can be made from concrete, polymer concrete, cast iron, galvanized steel, plastic or a fiberglass reinforced polymer matrix material consisting of an unsaturated polyester thermal setting resin matrix, glass fiber reinforcement and inorganic or mineral filler. The vault 10 can also be made from any of these materials. The lid includes through holes 28 and 30 positioned in opposing corners of the lid. Fasteners are incorporated to ridgedly attach the lid to the vault. The lid also includes an opening 32 for receipt of a hook to remove the lid from the vault as is known in the art.

Figure 4:
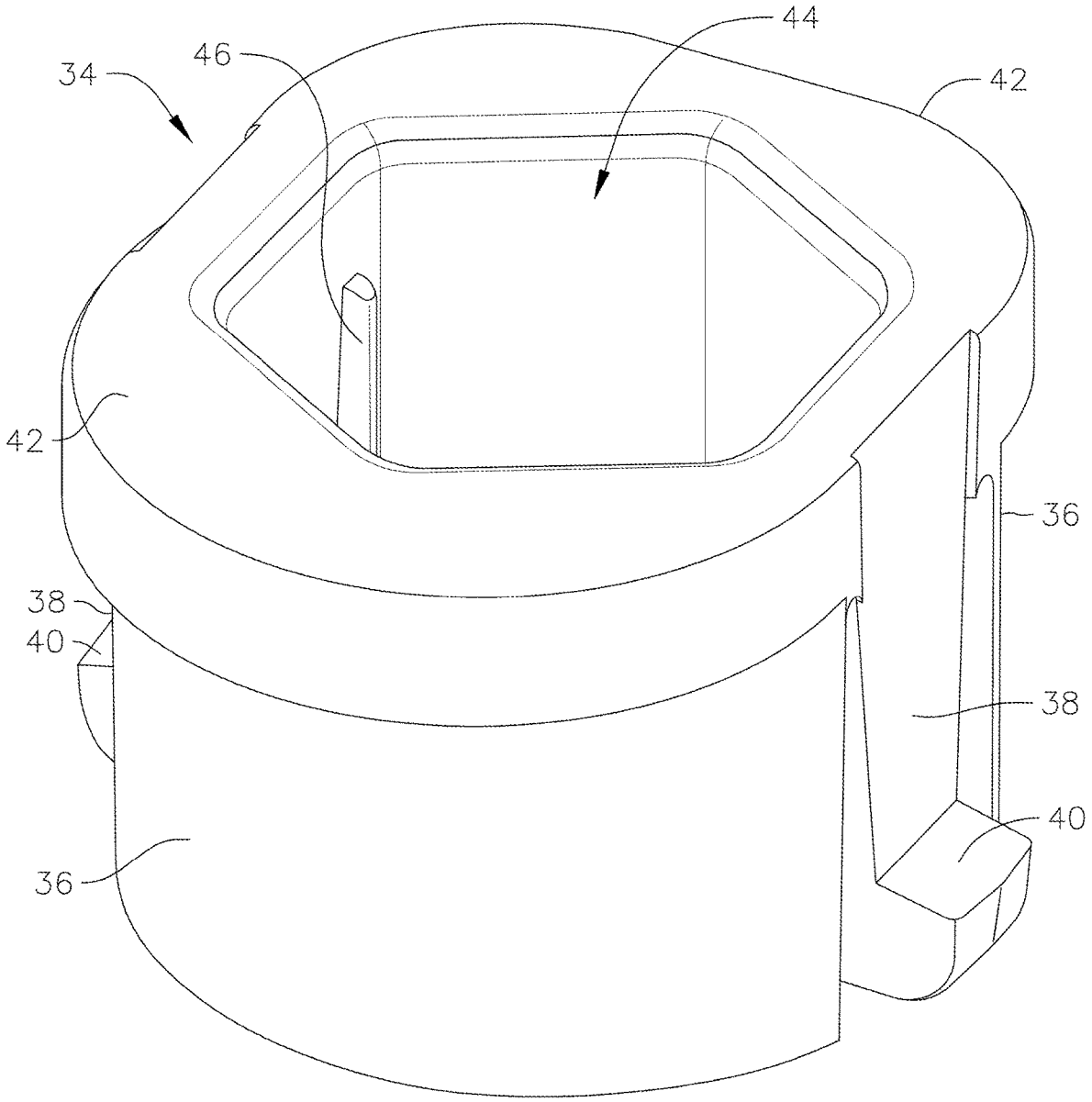
FIG. 4 is a perspective view of a fastener of the present invention.

Referring to FIG. 4 a first embodiment fastener 34 is illustrated. The fastener 34 has a generally cylindrical body portion 36 on opposite sides of the fastener. Positioned between each body portion 36 is a flexible flange 38 having a tab 40 positioned on a lower end of the flange. The fastener has a lobe 42 extending radially outwardly from the body portion 36 on either side and is positioned at an upper portion of the fastener to prevent over insertion of the fastener within the hole 20 in the lid. The fastener has a bore or hole 44 extending therethrough or partially therethrough and is illustrated, for example, as a hexagonal hole having six sides for receipt of post 18 although any geometrical shape for the bore will suffice. An indexing feature 46 extends from one of the sides of the bore and into the bore for receipt of an indexing groove 48 extending along the length of the post 18. The indexing feature and the groove align to one another to properly index the placard 14 when installed into the lid.

As shown in FIG. 3, fastener 34 is a one-side access fastener which is positioned in the hole by hand without tools by the flange 38 and tabs 40 compressing during insertion into the hole from the top surface of the lid such that when installed tabs 40 spring out and connect to the underside of the lid adjacent to the hole. Lobes 42 engage the recess 22 to prevent over insertion into the hole. The identification placard is then press fit into the fastener by a friction fit and indexed by receipt of the indexing feature 46 within groove 48 in the post. The sides of the bore 44 can be tapered to further accommodate the friction fit. Fastener 34 typically is constructed from thermoplastic material such as ABS or other flexible materials such as nylon or composites including fiberglass or graphite.

Figure 5:
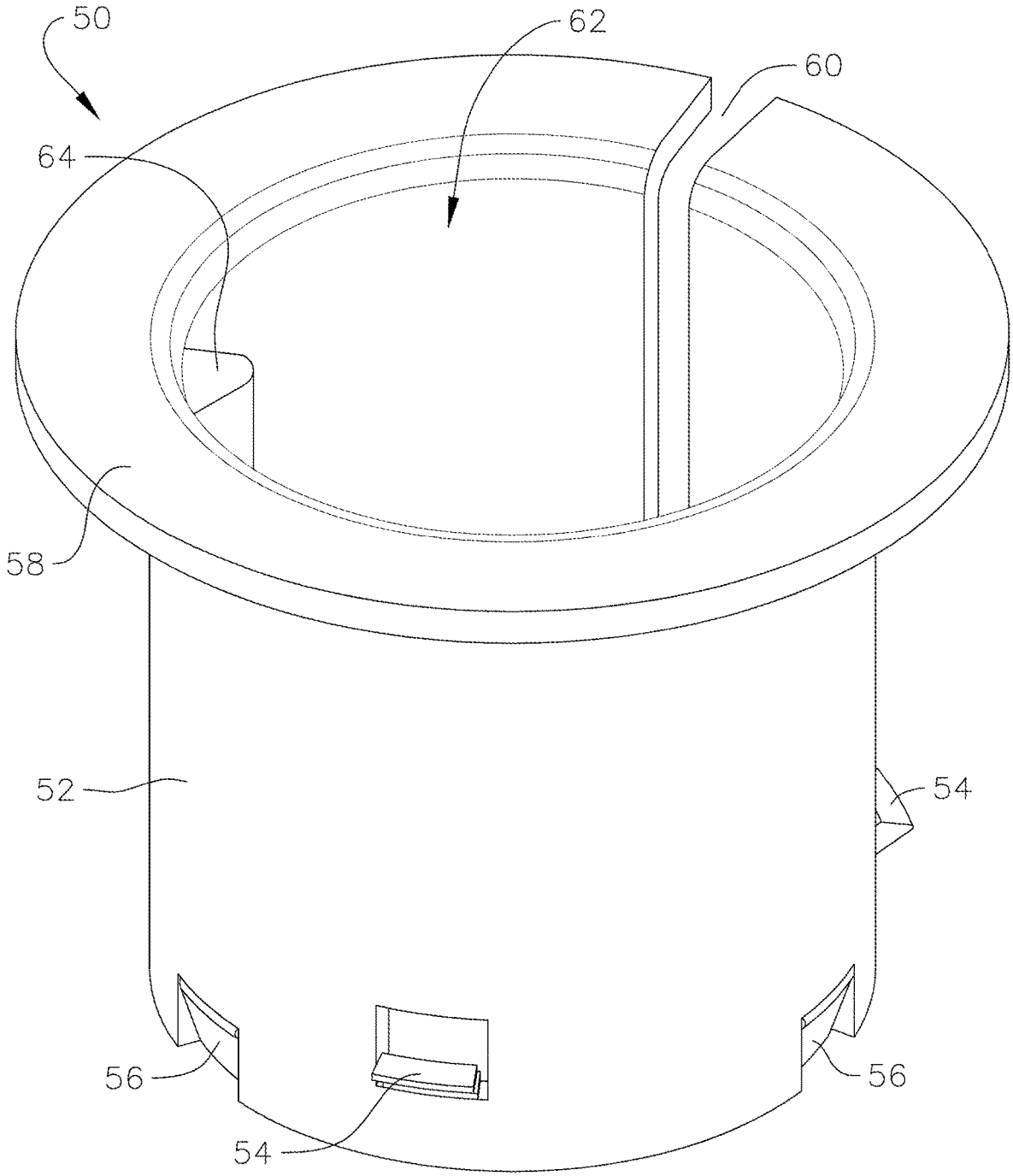
FIG. 5 is a perspective view of an alternative fastener of the present invention.

Referring to FIG. 5 an alternative embodiment fastener 50 is illustrated. Fastener 50 includes a generally cylindrical body portion 52 having a plurality of tabs 54 spaced around the body and barbs 56 positioned around a lower surface. The top includes an annular ring 58 and the fastener includes a split section 60 allowing the fastener to compress when being inserted into the hole 22 in the lid from the top surface of the lid. When positioned in the hole and the tabs 54 may clear the bottom of the hole 22, the fastener springs open and the tabs engage the bottom of the hole 22 or may embed into the surface of the hole 22 or may lock into annular grooves 55 in the surface of the hole 22 or other recessed or raised features in the surface of the hole 22. These various methods of engaging hole 22 allows for use in thru-holes or blind nonthru-holes. Ring 58 rests on the recess 22 to prevent over insertion. Tabs 54 lock the fastener in place within the hole in the lid. The fastener includes a cylindrical bore 62 for receipt of post 18. An indexing feature 64 is positioned within bore 62 for receipt of channel 48 in the post ensuring proper indexing or clocking of the placard 14 during installation. The bore 62 is sized to provide a friction fit for the post 18 when the placard is installed without the need for tools and the barbs 56 engage the post.

Figure 6:
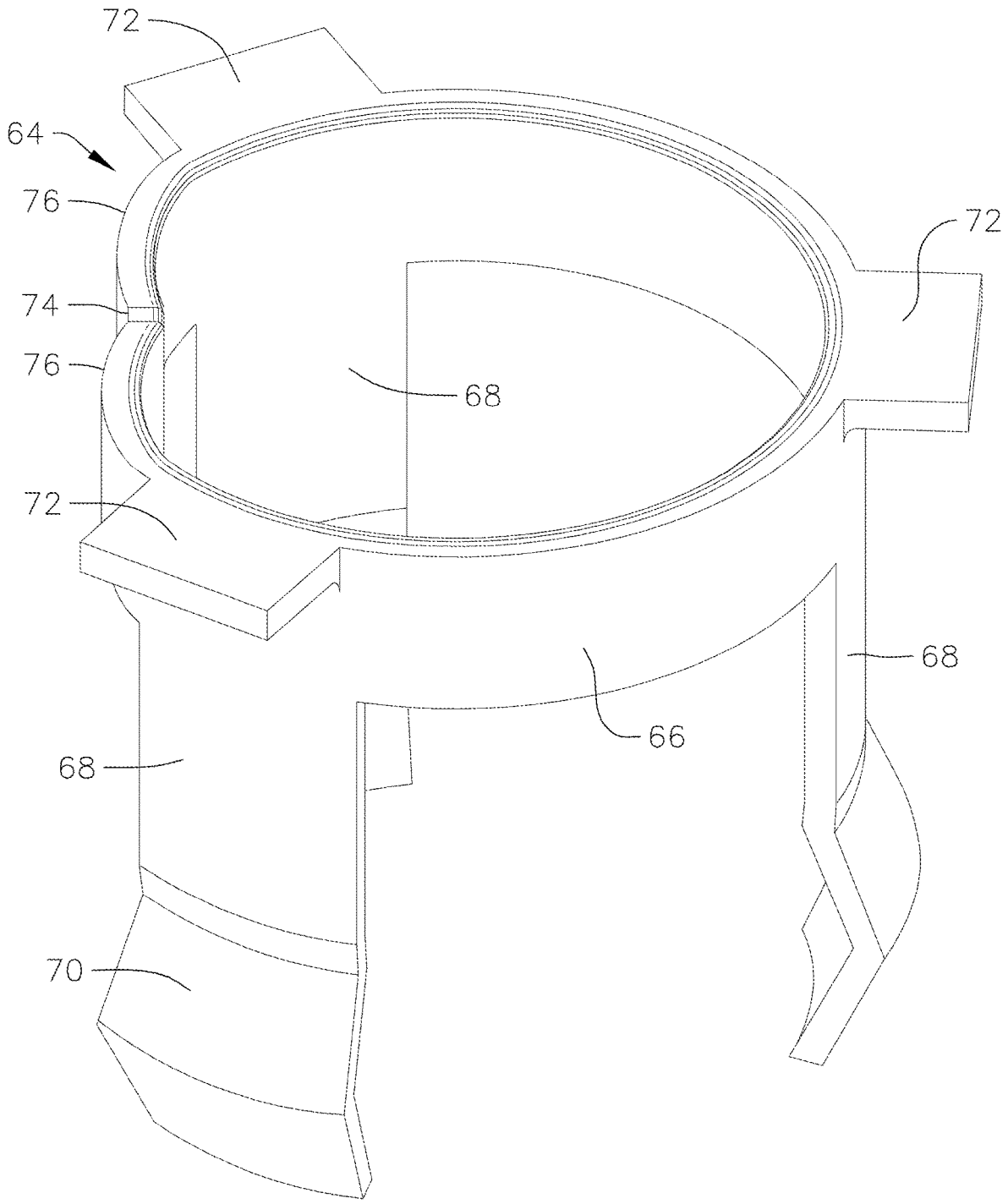
FIG. 6 is a perspective view of a second alternative fastener of the present invention.

Referring to FIG. 6, another alternative embodiment fastener 64 is illustrated. Fastener 64 includes a generally cylindrical body portion 66 having a plurality of flanges or prongs 68 extending downwardly therefrom and spaced apart. FIG. 6 illustrates three prongs 68, however, another number could be utilized. Each prong 68 includes an angled end portion 70 which would extend below the bottom end of the hole 20 in the lid. In use, the post 18 of the placard would push the angled portion outwardly such that the bottom end of the angled portion would engage the post and an upper end of the angled portion would engage the bottom surface of the lid around hole 20. Tabs 72 are spaced around the top of the body portion 66 to prevent over insertion of the fastener 64 into the hole. Body portion 66 includes a split section 74 and the body portion 68 adjacent either side of the split section 74 is curved inwardly 76 so that when the fastener 64 is positioned within a similarly geometrically shaped hole prevents rotation of the fastener and the placard once installed. Curved portion 76 can also act as an indexing function for the placard or the placard can utilize a separate indexing feature commonly known in the art.

Figure 7:
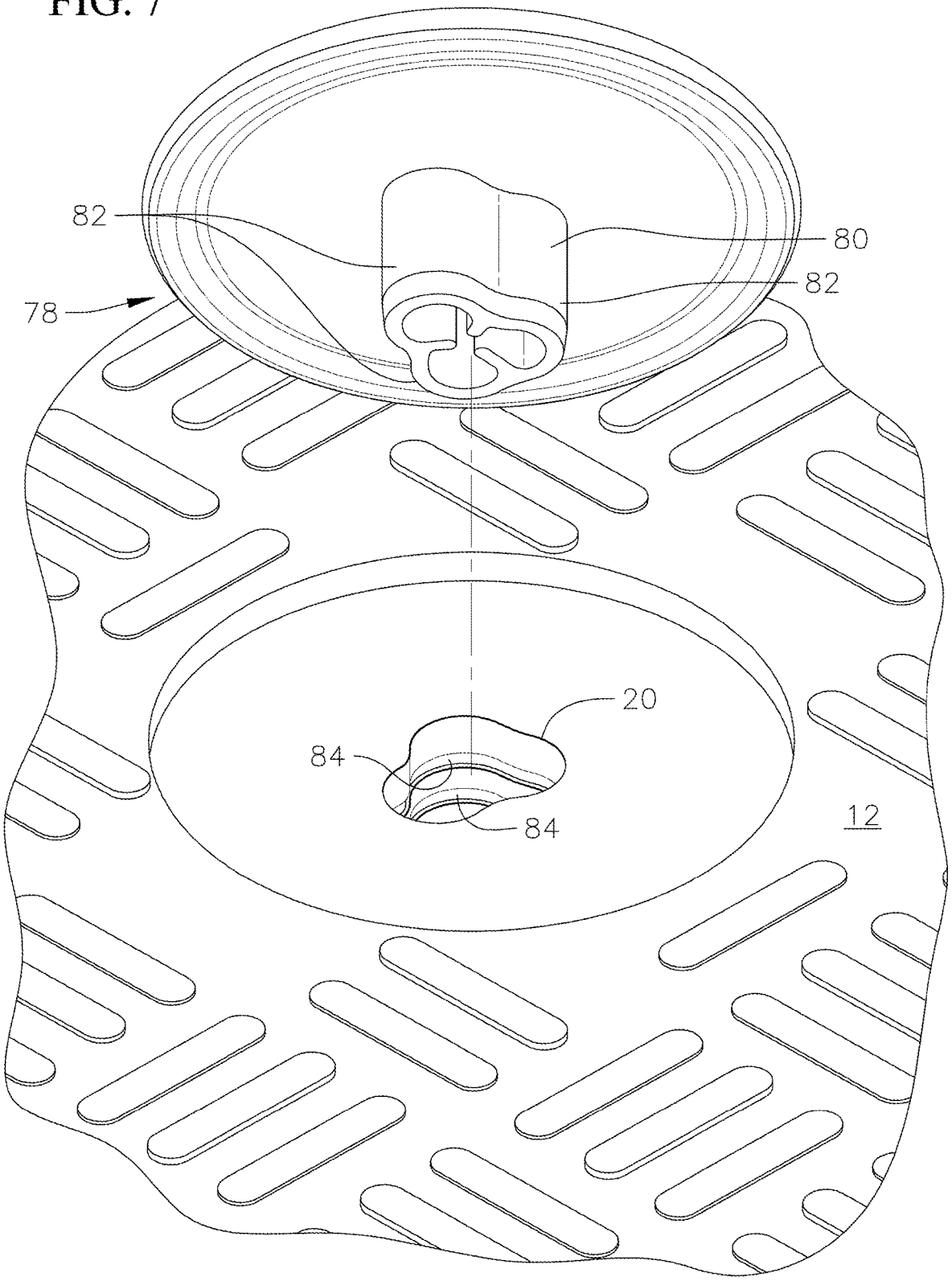
FIG. 7 is a perspective view of a third alternative fastener of the present invention.

Referring to FIG. 7, another alternative embodiment fastening system 78 is illustrated. In this embodiment, the post 80 has a lobed configuration wherein a plurality of lobes 82 are formed into the post. Three lobes are illustrated in the embodiment in FIG. 6 although it is to be understood that any number of lobes could be incorporated into the post. In this embodiment, the hole 20 in the lid 12 would have a corresponding geometrical shape for receipt of the lobes and the lobes would be manufactured so that installation could only occur in one orientation to provide for the indexing requirement. In this embodiment, the corresponding hole 20 would be sized to provide a friction/interference and/or compressive fit for post 68 causing the softer material to flow into annular 84 grooves or similar features for a positive mechanical interlocking of the components.

The fastening system of the present invention provides the advantage of installation of the identification placard from only one side of the lid into through or blind holes without tools. The fastening system provides for an indexing feature to ensure proper installation of the placard and the prevention of the placard from moving once installed.

Although the present invention has been described and illustrated with respect to a fastening system for an identification placard into a lid for utility vaults, it is to be understood that other applications of the inventive concepts are also possible. The invention provides for the attachment of components quickly together by requiring access to only one side of the components being fastened together and without the use of tools. Other applications could include electronic components such as screws or other fasteners pressed into a circuit board or a circuit board being attached to a housing, wooden component such as dowels and blind holes, plastic components such as plastic pins inserted into holes for containers. Although the fasteners of the present invention have been illustrated with respect to cylindrical bores or hexagonal bores, it is to be understood that the fastener can be easily configured to work with other geometrical shapes such as triangles, squares, ovals, or other post and hole configurations. Although the present invention has been disclosed and illustrated with respect to various embodiments thereof, it is to be understood that changes and modifications can be made therein which are within the full intended scope of the invention as hereinafter claimed.

What is claimed is:

1. A fastening system for attaching an identification placard having a post to a lid for a vault from a single side of the lid comprising:

a fastener having non-flexible body portions for positioning within a hole in the lid, the fastener having at least one flexible flange positioned between and not attached to the body portions that flexes independent of the body portions when the fastener is inserted into the hole, the flexible flange having a tab extending at an end of the flexible flange for retaining the fastener to a lower portion of the lid, the fastener having lobes extending radially outward from the body portions for preventing over insertion of the body portions into the hole in the lid; and a bore extending through the body portions for receipt of and friction or mechanical retention of the post of the identification placard;

wherein the identification placard is attached without the use of adhesives.

2. The system of claim 1 wherein the at least one flexible flange comprises two flexible flanges spaced from one another and positioned between the body portions.

3. The system of claim 1 wherein the bore has a polygonal configuration.

4. The system of claim 1 wherein the bore includes an indexing flange extending away from the bore for receipt of an indexing groove on the post.

5. The system of claim 1 wherein the bore has a tapered surface of non-uniform thickness.

* * * * *